US012690628B2

(12) United States Patent
Treiber et al.

(10) Patent No.: US 12,690,628 B2
(45) Date of Patent: Jul. 28, 2026

(54) NURSING BAND

(71) Applicant: MEDELA AG, Baar (CH)

(72) Inventors: Anita Treiber, Kilchberg (CH); Letizia Miotto, Zürich (CH); Sandra Rückewold, Madetswil (CH)

(73) Assignee: MEDELA AG, Baar (CH)

( * ) Notice: Subject to any disclaimer, the term of this patent is extended or adjusted under 35 U.S.C. 154(b) by 0 days.

(21) Appl. No.: 18/700,385

(22) PCT Filed: Oct. 20, 2022

(86) PCT No.: PCT/EP2022/079219
§ 371 (c)(1),
(2) Date: Apr. 11, 2024

(87) PCT Pub. No.: WO2023/067068
PCT Pub. Date: Apr. 27, 2023

(65) Prior Publication Data

US 2025/0089819 A1 Mar. 20, 2025

(30) Foreign Application Priority Data

Oct. 22, 2021 (EP) ..... 21204169

(51) Int. Cl.
*A41C 3/04* (2006.01)
*A41C 3/06* (2006.01)

(52) U.S. Cl.
CPC . *A41C 3/04* (2013.01); *A41C 3/06* (2013.01)

(58) Field of Classification Search
CPC ..... A41C 3/04; A41C 3/06
See application file for complete search history.

(56) References Cited

U.S. PATENT DOCUMENTS 1,863,697 A * 6/1932 Rutledge ..... D04B 1/246 66/202
1,948,076 A 2/1934 Notes
4,957,466 A * 9/1990 Hopps ..... A41C 3/0057 450/23

(Continued)

FOREIGN PATENT DOCUMENTS

GB 244584 A 12/1925
GB 311217 A 5/1929

OTHER PUBLICATIONS

International Search Report and Written Opinion of the International Searching Authority for Application No. PCT/EP2022/079219, dated Jan. 2, 2023.

(Continued)

*Primary Examiner* — Gloria M Hale
(74) *Attorney, Agent, or Firm* — MARSHALL, GERSTEIN & BORUN LLP

(57) ABSTRACT

A nursing band providing better comfort for the user and comprising a lower cuff adapted to encircle the chest of a breast feeding mother below the bust and an upper cuff adapted to encircle the chest of the breast feeding mother above the bust and an intermediate section extending between the lower cuff and the upper cuff, wherein the lower cuff, the upper cuff and the intermediate section have anisotropic properties, wherein the anisotropic properties of the intermediate section differ from the anisotropic properties of at least one of the lower cuff and the upper cuff.

15 Claims, 4 Drawing Sheets

(56) References Cited

U.S. PATENT DOCUMENTS

| | | | | |
|---|---|---|---|---|
| 5,636,533 | A | 6/1997 | Hunneke et al. | |
| D769,576 | S | 10/2016 | Kawasaki | |
| 9,706,796 | B2 | 7/2017 | Kawasaki | |
| 2010/0022164 | A1* | 1/2010 | Taylor | A41C 3/10 604/360 |
| 2015/0133028 | A1 | 5/2015 | Applewhite | |
| 2017/0290376 | A1* | 10/2017 | Maheshwari | D04B 21/207 |
| 2018/0255839 | A1* | 9/2018 | David | A41C 3/0007 |
| 2020/0397070 | A1* | 12/2020 | Kilbey | A41D 13/1245 |

OTHER PUBLICATIONS

European Search Report for Application No. EP21204169, dated Apr. 8, 2022.

* cited by examiner

NURSING BAND

CROSS-REFERENCE TO RELATED APPLICATION

This present application is the US national phase of International Patent Application No. PCT/EP2022/079219, filed Oct. 20, 2022, which claims priority to European Application No. 21204169.3, filed Oct. 22, 2021. The priority application, EP 21204169.3, is hereby incorporated by reference in its entirety.

The present invention relates to a nursing band in particular for a breast feeding mother, in particular for a breast feeding mother of freshly born babies.

In particular after birth, the breast of a mother is highly sensitive. Thus, the mother is not inclined to wear a regular bra.

Various attempts were made to conform with the mother's need for appropriate support and protection of the bust without exerting pressure on the same or rubbing against the bust.

GB 244,584 A discloses a brasserie comprising a breast-encircling part and a body-encircling part united to the breast-encircling part by a tuck and adapted to prevent the brasserie from riding up on the body. The breast-encircling part includes pockets closed by shaped pieces which may be fastened by press-buttons, and is narrowed and pleated at its ends which are adapted to overlap slightly and to be fastened at the back by elastic tabs and buttons. Elastic shoulder straps are provided. The body-encircling part is fastened by buttons and buttonholes and may be extended to form vest and knickers.

GB 311,217 A discloses a brasserie comprising overlapping sections which are supported by shoulder straps and are adapted to each receive a bust of the user. Each of the overlapping sections is connected to each of the shoulder straps by straps. On the back, the brasserie is circumferentially closed by buttons.

U.S. Pat. No. 1,948,076 A discloses a supporter for lactating breasts consisting of an oblong shaped band of material having a high elasticity in the longitudinal, i.e. circumferential direction of the body which material is relative inelastic in a direction transverse thereto. The longitudinal elasticity is substantially uniform across the width of the band. The band is circumferentially closed by a zipper, which zipper is provided to connect the ends of the band along the entire width thereof extending in the height direction of the user when standing. When put in place, the band offers positive support and lifts the breast without undue compression.

US 2015/0133028 A1 discloses a nursing brassiere comprising a bandeau formed of a stretchable material that extends from a front portion to a rear portion. The front portion has left and right cup areas that are separated by a clear cleavage portion. The outer fabric layer is affixed to a lower fabric layer along edge seams with a single attachment point within the center of the brassiere making it usable for both nursing and hands-free pumping.

The present invention aims to provide a support for the bust of a breast feeding mother.

As a solution to the above problem, the present invention provides a nursing band as defined in claim 1.

The inventive nursing band has a lower cuff adapted to encircle the chest of the breast feeding mother below the breast and an upper cuff adapted to encircle the chest of the breast feeding mother above the breast. The lower cuff is made of a lower cuff fabric. The upper cuff is made of an upper cuff fabric. Both cuffs can be made of the same fabric. The cuffs are to provide support and sufficient circumferential elasticity to hold the nursing band in place. The upper cuff is usually arranged above the actual busts of the user and below the armpit. The upper cuff is usually arranged just below the armpit in such a way, that movement of the arms is not impeded by the upper cuff.

The lower cuff is usually arranged at level of the *Processus xiphoideus* or below and above the belly button.

The upper cuff and the lower cuff have a height corresponding or longitudinal direction to the extension of the spine of the user of about 15 to 50 mm, preferably about 25 to 35 mm, most preferably about 30 mm.

The inventive nursing band has an intermediate section provided between the upper cuff and the lower cuff. The upper cuff and the lower cuff as well as the intermediate section are usually formed by a unitary band element, which band element is preferably made by knitting. By means of knitting, different functional areas can be formed and joined in a unitary body forming the nursing band. Thus, a seam or another interface which may irritate the skin and the feel of the user can be avoided.

On a general basis, the upper cuff, the lower cuff and the intermediate section are formed as a unitary band without seam and without any opening in circumferential or longitudinal direction.

According to the present invention, the intermediate section, the lower cuff section and upper cuff section each have anisotropic properties. In particular, the properties of each or individual or each sections of the inventive nursing band in longitudinal direction are different from the properties of respective section in circumferential direction. Moreover, respective properties of each of the sections are different. While the three sections may have the same properties in one direction, they would have different properties in the other direction. Preferably, the upper and the lower cuff have identical properties in each of the directions of interest, whereas the intermediate section will have properties different from those of the cuffs. Properties in this respect may be specific weight of the fabric, elasticity of the section or the fabric forming respective section, knitting structure of each section and or yarn properties in particular in terms of thickness, yarn roughness and yarn composition of the yarn used to make the fabric of each of the sections. A section in this respect may be each of the upper cuff the lower cuff and/or the intermediate section. Each of the sections is preferably made of a single material having identical properties in circumferential direction over the entire length and having identical properties in longitudinal direction over the entire circumference.

On a general basis, the properties of the cuffs are selected to provide enhanced securing of the nursing band against the body, for which circumferential strength is an important factor, whereas the intermediate section is to comfort the skin and support the busts without exerting noticeable pressure in particular on the busts. The nursing band is designed to only extend transversally around the body of the user in the transversally plane. The nursing band does usually not provide any material above the highest transversal extension and/or below the lowest transversal extension around the body of the user. Specifically, the nursing band usually does not have any securing means extending above upper cuff like e.g. shoulder straps to suspend the band in vertical direction.

Preferably, the intermediate section is formed of a fabric, which fabric has a lower specific weight and/or a higher elasticity than the lower cuff fabric and/or the upper cuff fabric. The specific weight is the weight of the texture material per $m^2$. The elasticity is the ability of the respective section of the nursing band to circumferentially expand upon a force effective in circumferential direction. In other words, the lower cuff and the upper cuff will provide a higher circumferential stress when being elongated by the same amount as the intermediate section. Thus and when mounting the nursing band thereby circumferentially expanding the band to a certain amount around the body of the user, the lower cuff and the upper cuff will provide the desired support by elastically wrapping around the body and holding the nursing band in place. The intermediate section will allow respective elongation without exerting a considerable pressure on the tissue, in particular the busts of the user.

The elongation of the upper cuff and the lower cuff is such that the entire nursing band is held in place thereby avoiding any relative movement between the material forming the band and the skin of the user at least and in particular on the front side of the body, specifically the busts and the nipples.

At least the intermediate section is preferably free of any joins, seams or connectors like buttons, pushbuttons, sliders or zippers. The inner surface contacting the body in particular on the front side preferably is completely smooth.

As the material forming the band is preferably a knitted textile, thanks to the knitting properties, each of the lower cuff, the upper cuff and the intermediate section have a certain elasticity. Thus, even pads covering the nipples for soaking up milk released by the nipples can be received within the nursing band and below the intermediate section without exerting a feeling of discomfort on the busts.

For enhancing the functionality of the lower or the upper cuff, the material forming the cuff can be provided in two or more layers. Those layers will be provided on the outer side of the nursing band. The inner side is usually flat for the reasons mentioned above.

The nursing brasserie of the present invention is adapted not to exert a high pressure on the bust of the breast feeding mothers. The elasticity and the size of the nursing band is to be selected such, that the bust is charged with a pressure of not higher than 7 mmHg, preferably not higher than 5 mmHg. The pressure charged by the upper or lower cuff above or below the busts may be slightly higher. Preferably, the upper or lower cuff shall not exert a pressure on the underlying skin higher than 9 mmHg, preferably not higher than 7 mmHg, most preferably not higher than 5 mmHg.

In order to comfort the busts of the user, the intermediate section preferably comprises two bust section, each being adapted to cover at least a part of one of the busts of the breast feeding mother. The intermediate section furthermore comprises a support section at least partially surrounding the two bust sections. The support section is made of a support section fabric. The bust section is made of a bust section fabric. The bust section fabric has a lower specific weight and/or a higher elasticity than the support section fabric. This difference pronounced in particular in the longitudinal direction. Both, the bust sections and the support section will preferably make up the intermediate section. In other words, the respective embodiment of the present invention consists of the upper and lower cuffs, the two bust sections and the support sections.

The support section usually provides the back of the intermediate section. In a non-use constitution, i.e. when the nursing band is not wrapped around the body of the user, the bust sections may already crinkle. The bust sections may have a circular or circular segment surface with a center angle of preferably between 220° and 320°. Such circular segment will intersect preferably with the upper cuff. The support section may be provided in-between the bust sections.

The support section preferably has knitted rips extending in longitudinal direction, which rips provide an enhanced longitudinal elasticity. Thus, the longitudinal elasticity is higher than the circumferential elasticity of the support section. The bust section usually has a plain outer appearance, whereas the cuffs may have a double ripped outer appearance. Added volume received within the bust sections may at least partially be followed by the support section by expansion in longitudinal direction while essentially maintaining the circumferential fit around the chest.

The support section may likewise be present between the lower cuff and the bust sections. In a non-use condition, the support section may be levelled with the upper cuff and/or the lower cuff and/or the intermediate section may circumferentially extend over the upper cuff and/or the lower cuff. While the support section may be flat, the bust sections partially surrounded by the support section or the upper cuff may not be expanded elastically to a great amount but may have an excess volume leading to crinkling of the bust section in the non-use condition.

For properly arranging a pad on the nipple, the nursing brasserie of the present invention may have a pad indicator adapted to indicate a holding position of a part on an inner side of the nursing band to cover the nipple of the assigned bust. Such pad indicator preferably is provided by colored yarn knitted for forming the nursing band. Preferably, said pad indicator is integrally formed in the knit of the intermediate section of said nursing band. It is also possible that the pad indicator is provided by a local variation of or in the knitted structure.

Preferably, the inventive nursing band may have pockets provided in the intermediate section. Usually, two pockets are provided adapted to removable hold pads on an inner side of the nursing brasserie. The pockets may be provided by darts adding additional volume to the intermediate section adapted to receive and with slight pressure about the respective pads against each of the busts.

In the inventive nursing bands, loops of the knitted texture material usually extend in longitudinal direction of the body whereas rows of loops extend perpendicular thereto, i.e. in circumferential direction. Due to the anisotropic properties of the knitted material, the bust section fabric and/or the support section fabric and/or at least one of the upper and the lower cuff fabric have a higher elasticity in longitudinal direction than in circumferential direction.

For the cuffs the elasticity in longitudinal direction is by a factor of about 2.8 to 4.2, preferably by a factor of about 3.2 to 3.8 higher than the elasticity in circumferential direction. For the support section the elasticity in longitudinal direction is by a factor of about 1.1 to 1.5, preferably by a factor of about 1.25 to 1.45 higher than the elasticity in circumferential direction.

For the bust section the elasticity in longitudinal direction is by a factor of about 1.1 to 1.6, preferably by a factor of about 1.25 to 1.5 higher than the elasticity in circumferential direction.

Practical experiments have revealed that the circumferential elasticity of the upper and the lower cuff at a longitudinal force of 1.5 N is between 10% and 15%. The longitudinal elasticity, i.e. the elasticity in height direction of the upper and lower cuff at the same force is between 45% and 51%.

In case of a uniform intermediate layer, the longitudinal elongation preferably is by a factor of 1.8 to 2.4 higher than the circumferential elongation. The circumferential elasticity of such an intermediate layer at a longitudinal force of 1.5 N is between 30% and 40%. The longitudinal elasticity, i.e. the elasticity in height direction of the uniform intermediate layer at the same force is between 70% and 90%.

In case of a support section fabric, the elongation at 1.5 N in circumferential direction is between 37% and 44% whereas the longitudinal elasticity of the support section preferably is between 50% and 57% elongation at 1.5 N. The bust section fabric has an elongation of between 40% and 45% at 1.5 N in circumferential direction. This circumferential elasticity is less than the longitudinal elasticity of the bust section fabric, which longitudinal elasticity is between 67% and 74% at 1.5 N longitudinal force.

To adapt the elasticity, preferably every forth needle of the knitted fabric forming the bust section fabric and/or the support section fabric and/or at least one of the upper and the lower cuff fabric is dropped. The yarn used for knitting the fabric preferably has between 87% to 98% polyester, preferably between 95% to 98% polyester. The rest is elastane. Most preferably, the yarn used for knitting the intermediate section and/or the bust sections does not contain any elastane. This yarn preferably contains 100% polyester.

The specific weight of the upper or lower cuff or upper or lower cuff fabric when arranged in two layers to form the double layered cuffs may be in the range of between 160 $g/m^2$ to 210 $g/m^2$, whereas the specific weight of the intermediate layer fabric may be in the range of 70 and 140 $g/m^2$. The bust section fabric preferably has a specific weight of between 70 and 100 $g/m^2$. The support section fabric preferably has a specific weight of between 90 and 130 $g/m^2$.

The present invention will become apparent from the following description of preferred embodiments in combination with the drawing. In the drawings.

Figure 1:
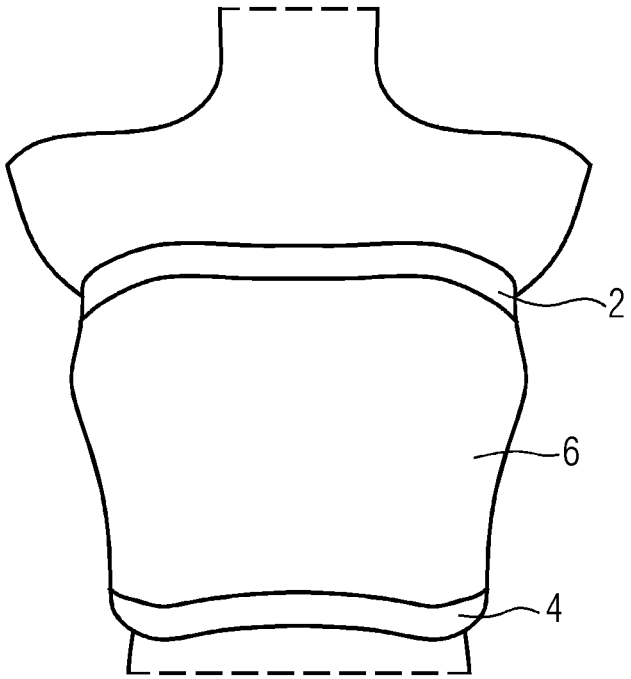
FIG. 1 is a front view of a first embodiment of the nursing band mounted on a mock female body.

FIG. 1 shows an embodiment of the inventive nursing band mounted on a mock female body. The nursing band consists of an upper cuff 2, a lower cuff 4 and an intermediate layer 6, each extending in horizontal, i.e. circumferential direction. Each of the upper cuff 2, the lower cuff 4 and the intermediate layer 6 are realized as single layers.

In the following description, circumferential is to indicate the direction around the body in a horizontal fashion with the user's standing whereas the longitudinal direction or extension corresponds to the longitudinal extension of the spine.

The upper cuff 2 has a longitudinal extension of about 30 mm. The lower cuff 4 has an identical longitudinal extension. The upper cuff 2 and the lower cuff 4 are realized by the same fabric material. This fabric material is a knitted fabric. By knitting, the interface between the upper cuff 2 and the intermediate layer 6 and the lower cuff 4 and the intermediate layer 6 is realized. The intermediate layer 6 is a knitted fabric. The loop density or loop formation of the loops forming the intermediate layer 6 is different from the knitted loops of the upper cuff 2 and the lower cuff 4.

The upper cuff 2 is made of an upper cuff fabric and the lower cuff 4 is made of a lower cuff fabric. Bothe fabric materials are laid in two layers to form the upper cuff 2 and the lower cuff 4. The intermediate layer 6 is made of a knitted fabric, which is joined to the double layer by knitting. Thus, the loops of both layers of the upper cuff 2 and the loops of both layers of the lower cuff 4 are joined to the loops of fabric material of the intermediate layer 6 provided in a single layer by knitting. Thus, the band is seamless.

The bent upper cuff fabric the bent lower cuff fabric on the upper and lower end of the nursing band each provide a curved and thus smooth outer contour at the two longitudinal ends of the nursing band.

The upper cuff 2 and the lower cuff 4 have a higher circumferential elasticity than the intermediate layer 6. At a given elongation due to a 1.5 N tensile force, the upper cuff 2 and the lower cuff 4 will exhibit an elongation of about 13%. The respective values for the intermediate layer 6 at a force of 1.5 N are 53% for the longitudinal elongation and 40% for the circumferential elongation.

The respective elongation values discussed above relate to a test piece of the respective fabric of 50 mm×50 mm, which is elongated between two clamps of a Zwick machine. The initial distance prior to stressing this sample between the clamps is 50 mm.

The specific weight of the upper cuff 2 is 180 $g/m^2$ whereas the specific weight of the intermediate layer 6 is between 85 and 90 $g/m^2$. The cuff has two layers of fabric material. Thus, the fabric forming the cuff 2 has a specific weight of 90 $g/m^2$.

The nursing band of FIG. 1 is a unitary elastic band which does not show or have any openings between the upper cuff 2 and the lower cuff 4. Specifically, the surface contacting the skin of the user is smooth including the transitions between each of the cuffs 2, 4 and the intermediate layer 6.

Due to the circumferential stress exerted by the upper cuff 2 and the lower cuff 4, the nursing band is held in place thus inhibiting a movement relative to the skin of the user, in particular the bust and the nipples thereof.

The inner surface in particular of the intermediate layer 6 exhibits a roughness suitable to contact and hold by friction any pads received within the band and covering the nipples of the busts.

The surface properties are provided by the knitting structure and the diameter of the yarn. The yarn has nominal titer (dtex) of 44 and an elongation according to DIN EN ISO 2062/Statimat of 21%+/−4. In the present embodiment, the fabric providing the intermediate layer 6 is a single layer circular knit with every fourth needle dropped. Dropping the fourth needle may result in an improvement of the elastic properties of the knit, as well as ensuring that the resulting fabric is more breathable. This can improve the user's comfort during wear. The intermediate layer 6 has the same knitting structure and density over the entire length and circumference.

Specifically, a seam or another interface, which may irritate the skin and feel of the user, are avoided. The inventive nursing band essentially is an elastic band, which spans around the chest of the user.

Figure 2:
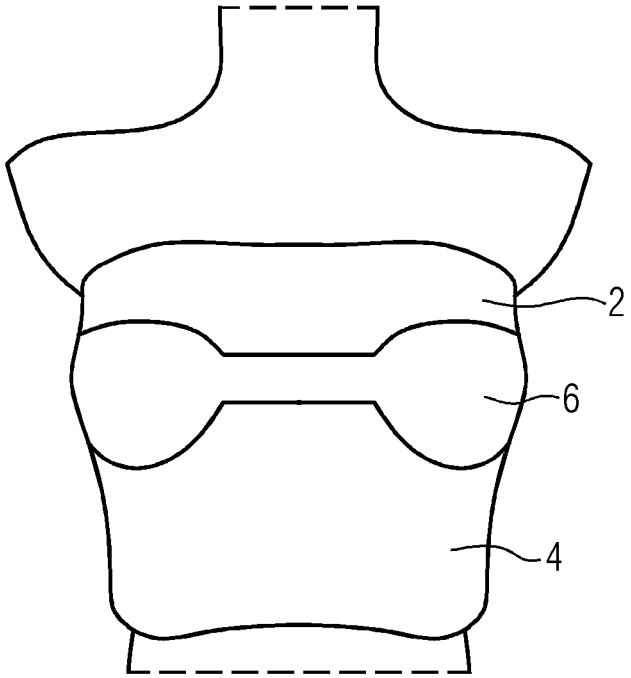
FIG. 2 is a front view of a second embodiment of the nursing band mounted on a mock female body.

FIG. 2 shows an alternate embodiment with wider bands forming the upper cuff 2 and the lower cuff 4. Front midsections of the upper cuff 2 and the lower cuff 4 extend horizontally when being used. Thus, the intermediate layer 6 forms a small vertical band extending over the sternum of the user with a longitudinal extension of about 40 to 80 mm. Corresponding to the shape of the busts, the upper cuff 2 has two concave interfaces to the intermediate layer 6 lateral of the sternum and in the front section of the nursing band. Correspondingly, the lower cuff 4 has concave sections. Thus, the intermediate layer 6 is formed to essentially cover at least the midsection of the busts of the user including the nipples. The intermediate layer 6 provides anatomically shaped bust areas.

The lower cuff 4 provides additional length in comparison to the embodiment of FIG. 1, which additional length provides improved positioning on the nursing band on the body of the user. Thus, the example of FIG. 2 is even less likely to move relative to the body of the user. The intermediate layer 6 will not slide over and rub against the nipples.

The embodiment of FIG. 2 again is a single layer solution in which each of the cuffs 2, 4 and the intermediate layer 6 are made of a single layer fabric. As in the first example of FIG. 1, the upper cuff 2 is arranged just below the axels of the user whereas the lower cuff 4 is level essentially with a belly button 8.

Figure 3:
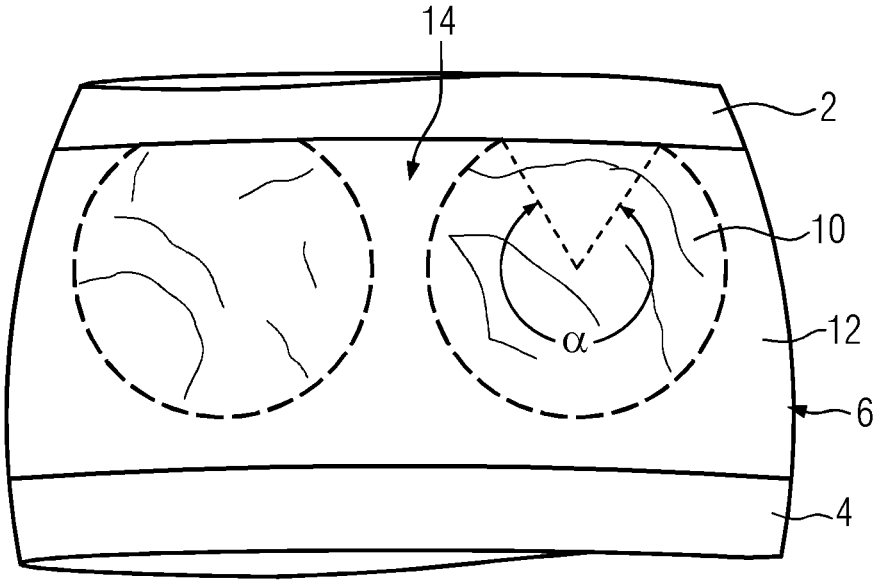
FIG. 3 is a front view of a third embodiment of the nursing band.

FIG. 3 elucidates a third embodiment in which the upper cuff 2 and the lower cuff 4 comprise double layers of the knitted texture material, each layer being connected to the intermediate layer by knitting, only.

The intermediate layer 6 is comprised of two bust sections 10 and a support section 12 disposed between the bust sections 10 and the lower cuff 4 and providing the entire back side of the intermediate layer 6.

Each bust section 10 has a ground surface of a circular segment with a center angle $\alpha$ of about 300°. This circular segment merges into the upper cuff 2 and is covered by said upper cuff 2.

The support section 12 has a mid-support section 14, which is level with the sternum of the user and is arranged between the bust sections 10. This mid-support section 14 extends in longitudinal direction. The mid-support section 14 has a common interface with the upper cuff 2. The support section 12 and the bust section 10 are joined by knitting, only.

The support section 12 has rips providing elasticity and support in circumferential direction. The elongation of the support section 12 at a force of 1.5 N in circumferential direction of the support section is about 41%. The elongation of the support section 12 in longitudinal direction at a force of 1.5 N is about 54%. As all respective elongation values discussed in the present application, those values relate to a test piece of the respective fabric of 50 mm×50 mm, which is elongated between two clamps of a Zwick machine. The initial distance prior to stressing this sample between the clamps is 50 mm.

The fabric forming the bust section 10 has a respective longitudinal elongation at 1.5 N of about 70% and a circumferential elongation at 1.5 N of about 42%. The specific weight of the bust section 10 is about 87 g/m$^2$. The specific weight of the support section is about 115 g/m$^2$. The double layer upper and lower cuff 2, 4 have specific weight of 190 g/m$^2$. This specific weight relates to the fabric laid out in a single layer fashion.

"About" in the description shall mean that each numerical value may vary with +/−5% of the respective numerical value given.

In a variant of the embodiment of FIG. 3, the support section 12 may only be provided on the front side whereas the fabric forming the bust section 10 likewise will form the entire rear section of the intermediate layer 6. Such embodiment will provide the user with a lighter feeling than the embodiment discussed for FIG. 3.

In the embodiment of FIG. 3, the bust sections 10 provide additional volume. In the non-used condition visible in FIG. 3, the bust sections 10 will crinkle. When being used, the bust sections 10 will therefore have an improved ability to adopt to the form of the busts.

Figure 9:
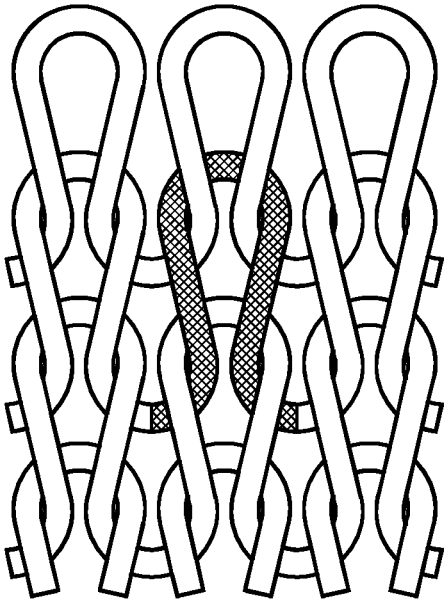
FIG. 9 is a schematic view of a first loop of the report.
Figure 10:
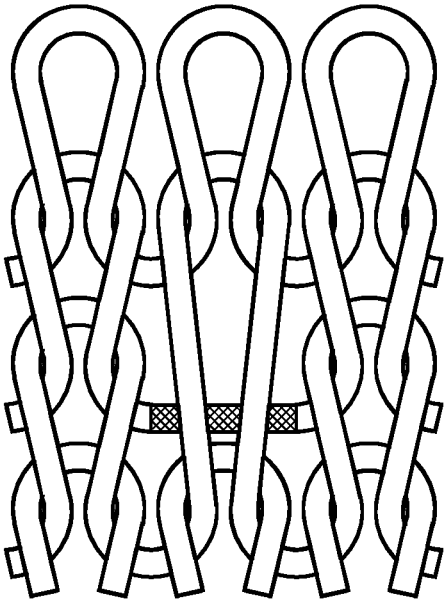
FIG. 10 is a schematic view of a second loop of the report.

FIGS. 9 and 10 basically elucidate the different knits utilized for making the fabrics. FIG. 9 elucidates the regular knit identified with X in the following reports. FIG. 10 shows the miss/float identified with O in the following documentation of the reports.

Generally, the combination of knit X and miss loops O are different in each of the bust section, the support section and the cuff section. The respective reports for each of the sections are identified below. As to the material, PES identifies polyester whereas EL and/or EA represent elastane as a component or as a separate yarn material within the fabric; compare in particular report of cuff section.

| | Bust section: Knitting pattern Report in circumferential direction | | | | | | | | Material |
|---|---|---|---|---|---|---|---|---|---|
| Report in longitudinal direction | X | X | ○ | X | X | X | ○ | X | PES |
| | ○ | X | ○ | X | ○ | X | ○ | X | PES + EL |
| | X | X | ○ | X | X | X | ○ | X | PES |
| | ○ | X | ○ | X | ○ | X | ○ | X | PES |
| | X | X | ○ | X | X | X | ○ | X | PES |
| | ○ | X | ○ | X | ○ | X | ○ | X | PES |
| | X | X | ○ | X | X | X | ○ | X | PES |
| | ○ | X | ○ | X | ○ | X | ○ | X | PES |

Report of bust section

| | Support section: Knitting pattern Report in circumferential direction | | | | | | | | Material |
|---|---|---|---|---|---|---|---|---|---|
| Report in longitudinal direction | ○ | X | ○ | X | ○ | ○ | ○ | ○ | PES |
| | X | X | ○ | X | X | X | ○ | X | PES + EA |
| | ○ | X | ○ | X | ○ | ○ | ○ | ○ | PES |
| | X | X | ○ | X | X | X | ○ | X | PES |
| | ○ | X | ○ | X | ○ | ○ | ○ | ○ | PES |
| | X | X | ○ | X | X | X | ○ | X | PES |
| | ○ | X | ○ | X | ○ | ○ | ○ | ○ | PES |
| | X | X | ○ | X | X | X | ○ | X | PES |

Report of support section

| | Cuff section: Knitting pattern Report in circumferential direction | | | | | | | | Material |
|---|---|---|---|---|---|---|---|---|---|
| Report in longitudinal direction | X | X | ○ | X | X | X | ○ | X | PES |
| | ○ | X | ○ | X | ○ | X | ○ | X | EL |
| | X | X | ○ | X | X | X | ○ | X | PES |
| | ○ | X | ○ | X | ○ | X | ○ | X | PES |
| | X | X | ○ | X | X | X | ○ | X | PES |
| | ○ | X | ○ | X | ○ | X | ○ | X | EL |
| | X | X | ○ | X | X | X | ○ | X | PES |
| | ○ | X | ○ | X | ○ | X | ○ | X | PES |

Report of cuff section

Figure 4:
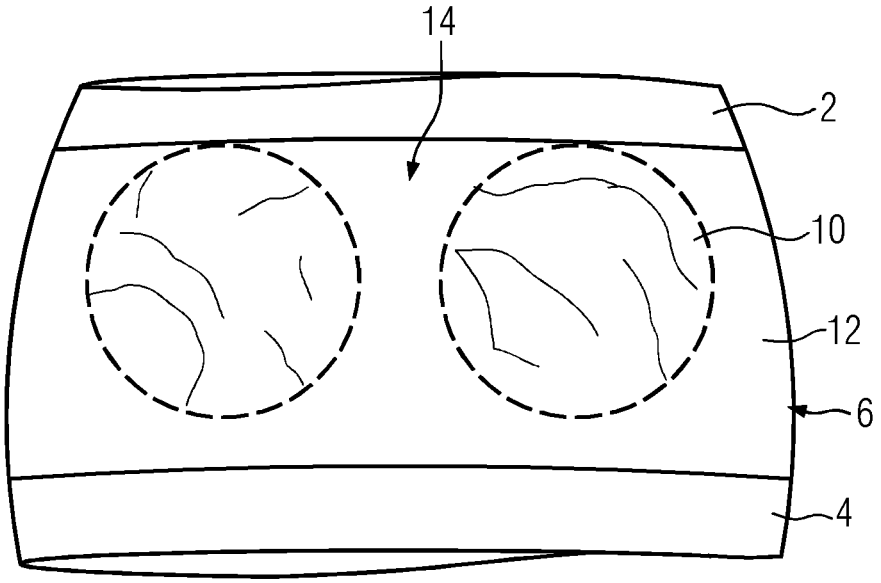
FIG. 4 is a front view of a fourth embodiment of the nursing band.

For the embodiment of FIGS. 3 and 4, the following loop height and width can be measured, wherein width corresponds to the number of loops in a 1×1 cm$^2$ of the fabric forming each of the bust section, the support section and the cuff section.

| | No. of loops - longitudinal direction | No. of loops - circumferential direction |
|---|---|---|
| bust section | 33 to 35 | 35 to 37 |
| support section | 39 to 41 | 37 to 39 |
| cuff section | 33 to 35 | 39 to 41 |

FIG. 4 is a variant to the embodiment of FIG. 3. The essential difference resides in the form of the bust sections 10, which are provided as full round circles just underneath the upper cuff 2 and surrounded by the support section 12.

Each of the embodiments discussed in FIGS. 1 to 4 have a smooth inner surface without any seams or three-dimensional obstacles at least on the inner side of the band, which could irritate the skin.

Figure 5:
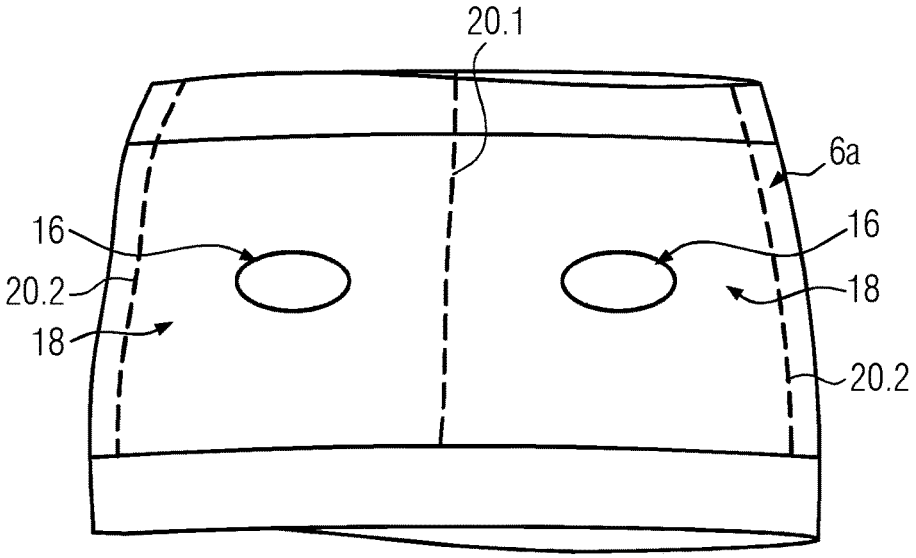
FIG. 5 is a front view of a fifth embodiment of the nursing band.

The general concept is different for the embodiment in FIG. 5, which shows the inner side of such embodiment. In this embodiment, the intermediate layer 6 has two layers. The inner side visible in FIG. 5 has two receptacles 16, made by cutting an inner layer 6*a* of the intermediate layer 6. Those receptacles 16 lead to pockets 18 being defined in horizontal, i.e. circumferential direction by the interface to the upper cuff 2 and the lower cuff 4, respectively. The lateral ends of the pockets 18 are formed by seams 20. An intermediate seam 20.1 is a common border for each of the pockets 18. The lateral end of each of the pockets 18 is formed by a respective lateral seam 20.2.

Each of the pockets 18 are adapted to receive a pad soaking up milk being released from the mother's breast. Those pads can be releasable held within the pocket 18.

Figure 6:
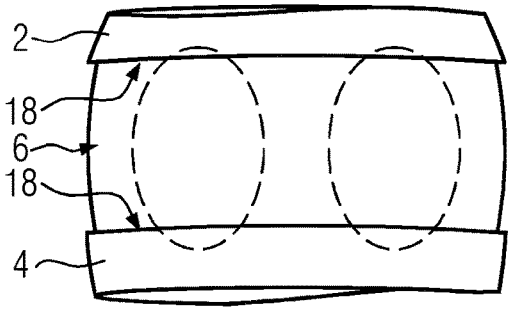
FIG. 6 is a schematic view of a sixth embodiment with a double layer structure.

FIG. 6 shows a further alternate embodiment of a double layer solution. In this embodiment, the upper cuff 2 and the lower cuff 4 are provided with two layers, whereas an inner layer of the upper cuff 2 and the lower cuff 4 each provide a slot for receiving upper and lower edges of a pad. The intermediate layer 6 has a single layer constitution and will sandwich the pads against the busts.

As in the previous embodiment, the band will have only a single layer constitution at a position corresponding to the position of the nipples. Thus, the very sensitive nipples are not irritated by an interface between different layers of the fabric material forming the nursing band.

Figure 7:
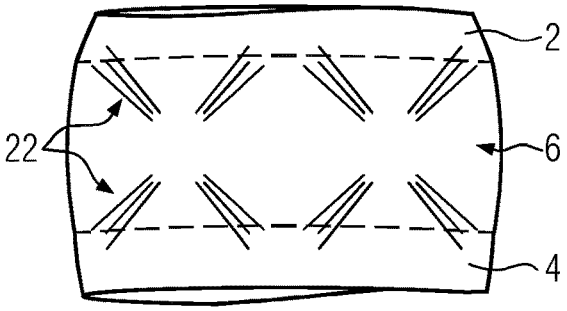
FIG. 7 is a schematic view of a seventh embodiment with a double layer structure.

In the variant of FIG. 7, which shows the outer side of the band, added volume for receiving the busts and pads is provided by darts 22 formed within the fabric defining the intermediate layer 6. In this embodiment the intermediate layer 6 is a single layer at level of the nipples.

Figure 8:
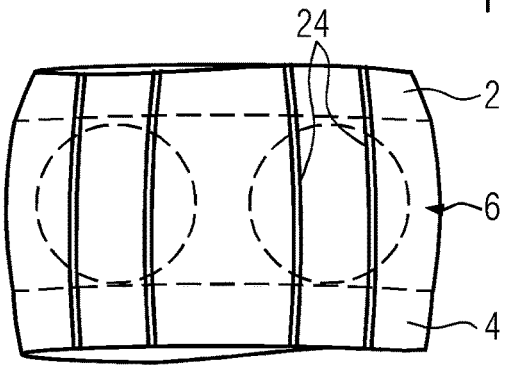
FIG. 8 is a schematic view of a eight embodiment with a single layer structure.

In the embodiment of FIG. 8, straps 24 are provided extending in longitudinal direction side by side in a group of two for each bust and with lateral distance to the position of the nipple. Those straps 24 are provided on the inner side of the intermediate layer 6. Two straps will are capable of securing one of the pads for holding the pad in place.

LIST OF REFERENCE SIGNS

2 upper cuff
4 lower cuff
6 intermediate layer
6*a* inner layer
8 belly button
10 bust section
12 support section
14 mid support section
16 receptacle
18 pockets
20 seam
20.1 intermediate seam
20.2 lateral seam
22 dart
24 strap
$\alpha$ center angle

What is claimed is:

1. A nursing band comprising a lower cuff adapted to encircle a chest of a breast feeding mother below a bust defined by two breasts of the breast feeding mother, and an upper cuff adapted to encircle the chest of the breast feeding mother above the bust and an intermediate section extending between the lower cuff and the upper cuff, wherein the lower cuff, the upper cuff and the intermediate section have anisotropic properties, wherein the anisotropic properties of the intermediate section differ from the anisotropic properties of at least one of the lower cuff and the upper cuff, wherein the lower cuff is made of a first fabric, the upper cuff is made of a second fabric and the intermediate section is made of a fabric having a lower specific weight and/or a higher circumferential elasticity than the first fabric and/or the second fabric, and wherein the intermediate section comprises two portions, each of the two portions being adapted to cover at least part of one of the two breasts of the bust of the breast feeding mother, and the intermediate section further comprises a support section at least partially surrounding the two portions, the support section made of a third fabric, wherein the two portions are made of a fourth fabric having at least one of a lower specific weight (g/m) and a higher elasticity than the third fabric.

2. The nursing band comprising according to claim 1, wherein the intermediate section has a lower specific weight and/or a higher circumferential elasticity than the lower cuff and/or the upper cuff.

3. The nursing band according to claim 1, wherein the intermediate section is adapted not to exert a pressure higher than 7 mmHg, on the bust of the breast feeding mother.

4. The nursing band according claim 1, wherein the two portions are cup shaped to conform with a shape of the bust of the breast feeding mother.

5. The nursing band according to claim 1, wherein the intermediate section comprises a pad indicator adopted to indicate a holding position of a pad on an inner side of the nursing band and covering one of two nipples of the bust of the breast feeding mother.

6. The nursing band according to claim 1, wherein the intermediate section has pockets adapted to removably hold pads on an inner side of the nursing band, which pads are adapted to cover one of two nipples of the bust of the breast feeding mother.

7. The nursing band according to claim 1, wherein the intermediate section has a front intermediate section and a back intermediate section, wherein the back intermediate section is made of the fourth fabric.

8. The nursing band according to claim 1, wherein the fabric and/or the third fabric and/or at least one of the second fabric and the first fabric have a higher elasticity in longitudinal direction than in circumferential direction.

9. The nursing band according to claim 1, wherein at least one of the fourth fabric, the-third fabric, and at least one of the second fabric and the first fabric, are knitted fabrics.

10. A nursing band comprising a lower cuff adapted to encircle a chest of a breast feeding mother below a bust defined by two breasts, and an upper cuff adapted to encircle the chest of the breast feeding mother above the bust of the breastfeeding mother and an intermediate section extending between the lower cuff and the upper cuff, wherein the lower cuff, the upper cuff and the intermediate section have anisotropic properties;

wherein the anisotropic properties of the intermediate section differ from the anisotropic properties of at least one of the lower cuff and the upper cuff;

wherein the lower cuff is made of a first fabric, the upper cuff is made of a second fabric and the intermediate section is made of a fabric having a lower specific weight and/or a higher circumferential elasticity than the first fabric and/or the second fabric;

wherein the intermediate section comprises two portions, each of the two portions being adapted to cover at least part of one of the two breasts of the bust of the breast feeding mother, and further comprises a support section at least partially surrounding the portions made of a third fabric;

wherein the portions are made of a fourth fabric having at least one of a lower specific weight (g/m) and a higher elasticity than the third fabric;

wherein at least one of the fourth fabric, the third fabric, and at least one of the second fabric and the first fabric, are knitted fabrics; and wherein every $4^{th}$ needle is dropped in the knitted fabric.

11. The nursing band according to claim 1, wherein the intermediate section is made of a yarn not containing any elastane.

12. The nursing band according to claim 9, wherein the knitted fabrics are each joined by knitting.

13. The nursing band according to claim 1, wherein the nursing band does not have straps, and the upper cuff and lower cuff provide support by elastically and horizontally wrapping around the chest of the breast feeding mother.

14. The nursing band according to claim 13, wherein the intermediate section has an inner surface that is completely smooth.

15. The nursing band according to claim 13, wherein the intermediate section is adapted not to exert a pressure higher than 7 mmHg, on the bust of the breast feeding mother.

* * * * *